US011022261B2

(12) United States Patent
Hawthorne et al.

(10) Patent No.: US 11,022,261 B2
(45) Date of Patent: Jun. 1, 2021

(54) UPLIGHT SHADOW REDUCTION FOR PENDANT LIGHTING FIXTURES

(71) Applicant: Hubbell Incorporated, Shelton, CT (US)

(72) Inventors: Sean Michael Hawthorne, Boston, MA (US); Rachel Lynn Sidiropoulos, Middleboro, MA (US); Jeremy Ogg, Rockland, MA (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/866,540

(22) Filed: Jan. 10, 2018

(65) Prior Publication Data

US 2018/0195678 A1 Jul. 12, 2018

Related U.S. Application Data

(60) Provisional application No. 62/500,012, filed on May 2, 2017, provisional application No. 62/445,090, filed on Jan. 11, 2017.

(51) Int. Cl.

| | |
|---|---|
| ***F21S 8/06*** | (2006.01) |
| *F21V 15/01* | (2006.01) |
| *F21Y 115/10* | (2016.01) |
| *F21V 7/00* | (2006.01) |
| *F21Y 105/18* | (2016.01) |
| *F21S 9/02* | (2006.01) |

(52) U.S. Cl.

CPC ..... *F21S 8/061* (2013.01); *F21S 9/02* (2013.01); *F21V 7/0008* (2013.01); *F21V 15/01* (2013.01); *F21Y 2105/18* (2016.08); *F21Y 2115/10* (2016.08)

(58) Field of Classification Search

CPC ..... F21S 8/061; F21S 9/02; F21S 8/04; F21S 8/063; F21S 8/065; F21S 8/00; F21V 7/0008; F21V 15/01; F21Y 2105/18; F21Y 2115/10; E04B 9/006

USPC ..... 362/147

See application file for complete search history.

(56) References Cited

U.S. PATENT DOCUMENTS

| | | | | |
|---|---|---|---|---|
| 1,529,822 A * | 3/1925 | Adam | F21S 8/04 | 362/429 |
| 2,093,165 A * | 9/1937 | Flood, Jr. | F21S 8/06 | 362/223 |
| D687,589 S * | 8/2013 | Wick | D26/90 | |
| 2009/0072970 A1* | 3/2009 | Barton | F21S 9/022 | 340/540 |

(Continued)

FOREIGN PATENT DOCUMENTS

| | | |
|---|---|---|
| GB | 2394529 | 4/2004 |

*Primary Examiner* — Rajarshi Chakraborty
*Assistant Examiner* — Fatima N Farokhrooz
(74) *Attorney, Agent, or Firm* — Michael Best & Friedrich, LLP

(57) ABSTRACT

An uplight assembly for pendant lighting fixtures includes a housing, a circuit board, and a diffuser optical element. The housing is configured to be secured to a pendant lighting fixture. The circuit board defines an aperture to accommodate a hanging support for the pendant lighting fixture. The circuit board includes a plurality of light sources at least partially surrounding the aperture. The diffuser optical element is in optical communication with the plurality of light sources.

17 Claims, 9 Drawing Sheets

(56) References Cited

U.S. PATENT DOCUMENTS

| | | | | |
|---|---|---|---|---|
| 2010/0188850 | A1* | 7/2010 | Maxik | F21S 8/088<br>362/249.06 |
| 2013/0051017 | A1* | 2/2013 | Heim | F21S 8/04<br>362/247 |
| 2014/0126193 | A1* | 5/2014 | Dixon | F21S 8/063<br>362/217.02 |
| 2015/0300617 | A1 | 10/2015 | Katona et al. | |
| 2015/0345743 | A1* | 12/2015 | Trincia | F21S 4/28<br>362/217.05 |
| 2016/0154168 | A1* | 6/2016 | Gassner | F21V 11/02<br>362/606 |
| 2017/0276327 | A1* | 9/2017 | Clark | F21S 8/063 |

* cited by examiner

UPLIGHT SHADOW REDUCTION FOR PENDANT LIGHTING FIXTURES

PRIORITY CLAIM

The present application claims the benefit of priority of U.S. Provisional Patent Application No. 62/445,090, entitled "UPLIGHT SHADOW REDUCTION FOR PENDANT LIGHTING FIXTURES," filed Jan. 11, 2017, which is incorporated herein by reference for all purposes. The present application also claims the benefit of priority of U.S. Provisional Patent Application No. 62/500,012 entitled "UPLIGHT SHADOW REDUCTION FOR PENDANT LIGHTING FIXTURES," filed May 2, 2017, which is incorporated herein by reference for all purposes.

FIELD

The present subject matter relates generally to lighting fixtures.

BACKGROUND

Lighting fixtures can be used for providing lighting for a space, such as a building or room. Lighting fixtures can be mounted to a ceiling or other surface by securing the lighting fixture to mounting hardware secured on or within the surface. For instance, a pendant lighting fixture can be suspended (e.g., using cables or other hanging support) from mounting hardware mounted on or within a ceiling.

When using one or more uplights on a pendant mount lighting fixture (e.g., a pendant hanging cylinder), the hanging support(s) (e.g., cable, wire, stem, etc.) can be highlighted on the ceiling due to the light creating shadows as it shines across the hanging support. This can create a visible and unsightly shadow on the illuminated surface. As a result, pendant mount lighting fixtures, such as pendant mount cylinder lighting fixtures, often do not come with an uplight option.

BRIEF DESCRIPTION

Aspects and advantages of embodiments of the present disclosure will be set forth in part in the following description, or may be learned from the description, or may be learned through practice of the embodiments.

One example aspect of the present disclosure is directed to a pendant lighting fixture system. The system includes a pendant lighting fixture; at least one hanging support for supporting the pendant lighting fixture; and an uplight assembly secured to the pendant lighting fixture. The uplight assembly comprises a plurality of light sources arranged to provide light on the at least one hanging support from a plurality of different directions.

Another example aspect of the present disclosure is directed to an uplight assembly for pendant lighting fixtures. The uplight assembly includes a housing, a circuit board, and a diffuser optical element. The housing is configured to be secured to a pendant lighting fixture. The circuit board defines an aperture to accommodate a hanging support for the pendant lighting fixture. The circuit board includes a plurality of light sources at least partially surrounding the aperture. The diffuser optical element is in optical communication with the plurality of light sources.

Variations and modifications can be made to these example embodiments of the present disclosure.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
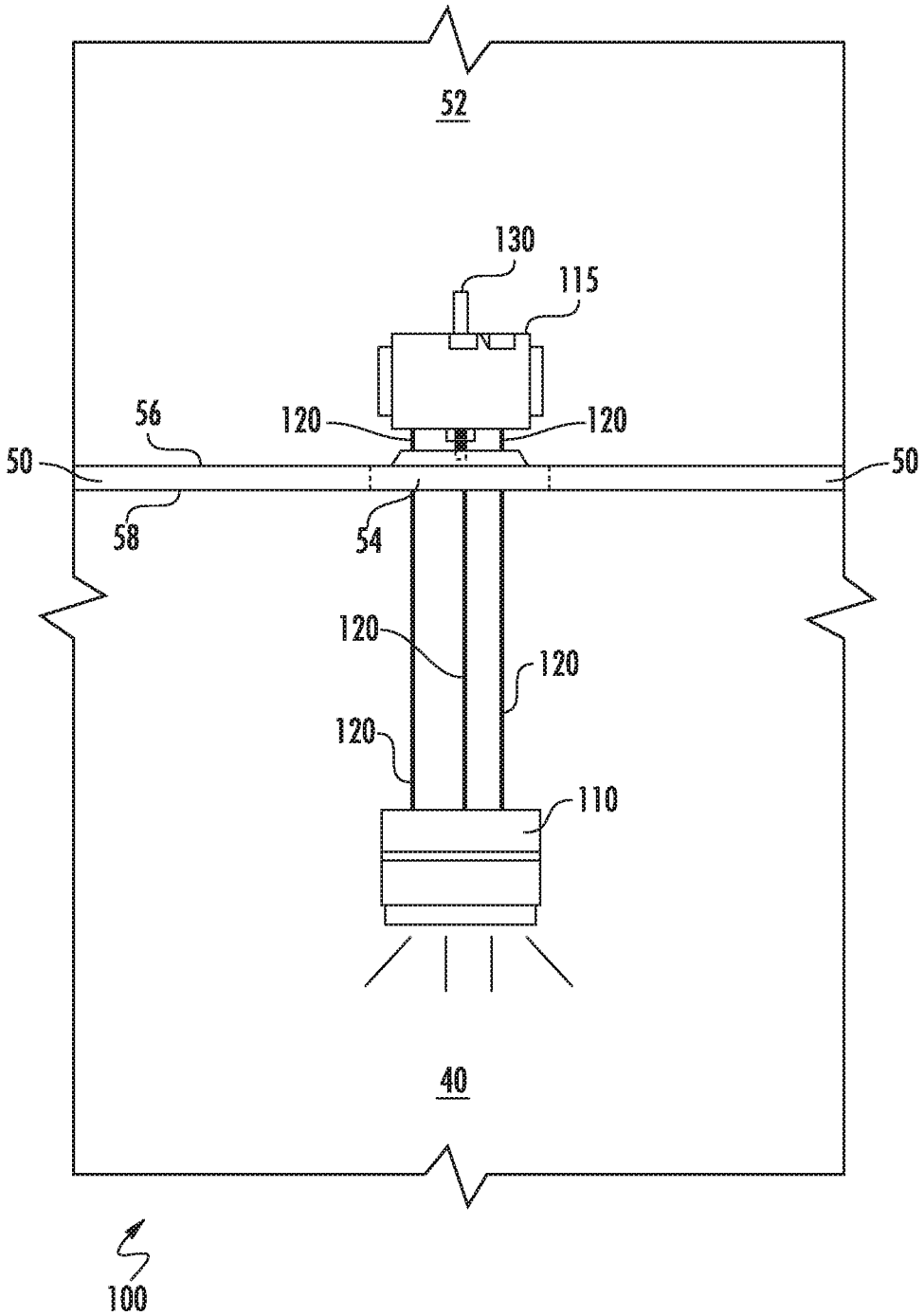
FIG. 1 depicts an example pendant lighting fixture suspended from a ceiling according to example embodiments of the present disclosure.
Figure 2:
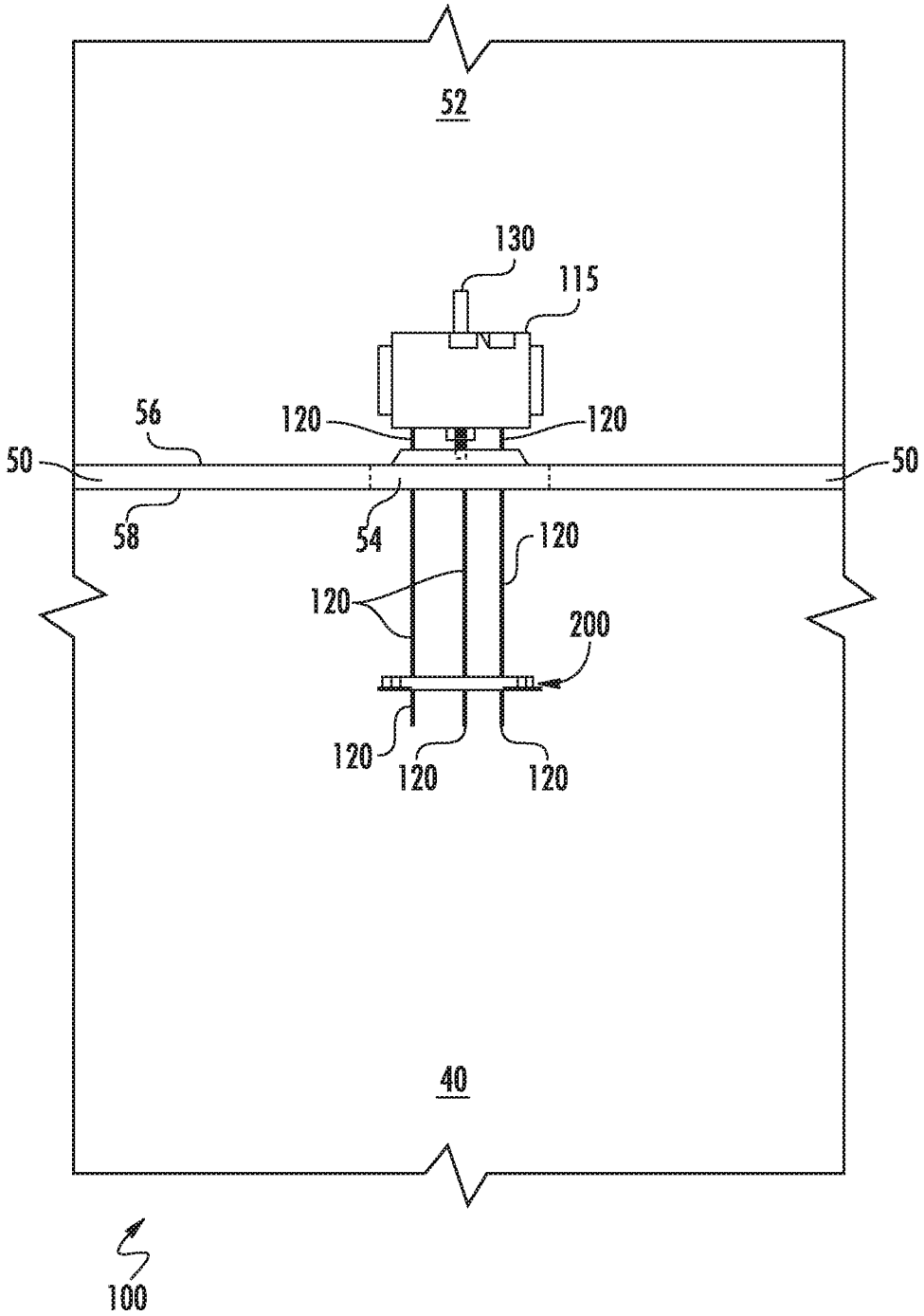
FIG. 2 depicts an example uplight assembly according to example embodiments of the present disclosure.
Figure 3:
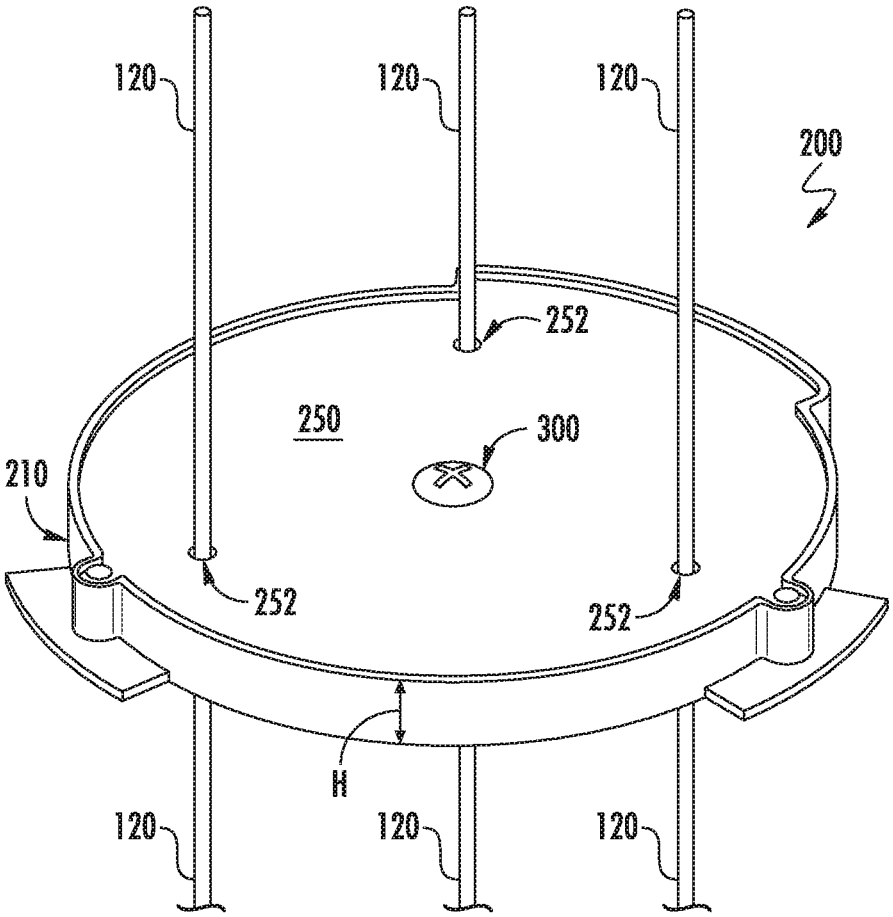
FIG. 3 depicts a perspective view of the example uplight assembly depicted in FIG. 2.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to an uplight assembly for use in conjunction with pendant lighting fixtures, such as for instance, point source pending lighting fixtures. In some embodiments, a hanging pendant lighting fixture can include an uplight assembly having a plurality of light sources. The plurality of light sources can be, for instance, light emitting diode (LED) light sources. The plurality of light sources can be positioned around each hanging support so as to reduce shadows that result from each hanging support and appear on a lit surface, such as the ceiling positioned above the pendant lighting fixture.

In some embodiments, a diffuser optical element (e.g., a diffuser lens) can be positioned in optical communication with the plurality of light sources to create a more uniform light distribution. In this way, shadows resulting from each hanging support can be more fully reduced. As such, hanging pendant point source lighting fixtures with uplights can become an option for illuminating a space where previously linear lighting fixtures are typically used.

For instance, in one example embodiment, a hanging pendant lighting fixture can be suspended from a ceiling or other surface using one or more hanging supports. The pendant lighting fixture source can include an uplight assembly. The uplight assembly can include an LED board (e.g., a light engine) having a plurality of LED devices positioned on the LED circuit board. The hanging supports can pass through the LED circuit board. The plurality of LED devices can be arranged so as to at least partially surround or, in some embodiments, fully surround each of the one or more hanging supports. In this way, the plurality of LED devices can provide light onto each of the one or more hanging supports from multiple directions so that shadows resulting from each of the one or more hanging supports can be reduced. In some embodiments, the LED circuit board can be positioned within a cavity defined by a housing of the uplight assembly. The uplight assembly can also include a diffuser optical element that can be mounted to the housing. In particular, the housing can be affixed to a hanging pendant lighting fixture so that the LED devices can provide uplighting with reduced shadows according to example embodiments of the present disclosure.

FIG. 1 depicts an example pendant lighting fixture system 100 according to example embodiments of the present disclosure. The pendant lighting fixture system 100 can include a pendant lighting fixture 110 (e.g., a hanging pendant cylinder) having one or more light sources (e.g., LED light sources) configured to provide illumination for a space 40.

The pendant lighting fixture 110 can be suspended from a mounting component 115 (e.g., a junction box) using a plurality of hanging supports 120. The hanging supports 120 can be, for instance, cables, wires, stems, or other suitable hanging supports 120 that can pass through an opening 54 defined by a ceiling 50. In one example embodiment, the plurality of hanging supports 120 can be Class 2 power over aircraft cable. It should be appreciated that more or fewer hanging supports 120 can be used without deviating from the scope of the present disclosure.

As shown, the mounting component 115 can be secured to a support 130 positioned within a plenum 52 or other space located above the ceiling 50. However, it should be appreciated that other suitable mounting arrangements can be used without deviating from the scope of the present disclosure. In one example embodiment, the support 130 can be exposed to the space 40 positioned below the ceiling 50.

Referring now to FIGS. 2 through 7, the lighting fixture system 100 can include an uplight assembly 200 configured to illuminate the ceiling 50 located above the pendant mount lighting fixture 110. As shown, the uplight assembly 200 can include a housing 210. In an example embodiment, the housing 210 can define a shape that is similar to the shape of the pendant lighting fixture 110. Alternatively or additionally, the housing 210 can be comprised of aluminum. It should be appreciated, however, that the housing 210 can be comprised of any suitable material.

As shown, a bottom portion 212 of the housing 210 can define a first plurality of apertures 214. In an example embodiment, each aperture of the first plurality of apertures 214 can accommodate one of the hanging supports 120 passing therethrough to support the pendant lighting fixture 110. Alternatively or additionally, the bottom 212 of the housing 210 can define a second plurality of apertures 216. As will be discussed below in more detail, each aperture of the second plurality of apertures 216 can accommodate a mechanical fastener extending therethrough so that a circuit board can be mounted to the bottom 212 of the housing 210.

The housing 210 can also include a boss 218 and a sidewall 220. As shown, the boss 218 can extend from the bottom 212 of the housing 210. In example embodiments, the boss 218 can extend from a center of the bottom 212. Alternatively or additionally, the sidewall 220 can extend from the bottom 212 of the housing 210. In example embodiments, the sidewall 220 can surround a perimeter of the bottom 212 so that the bottom 212 and the sidewall 220 collectively define a cavity 230. As will be discussed below in more detail, the uplight assembly 200 can include a circuit board that can be positioned within the cavity 230.

Figure 5:
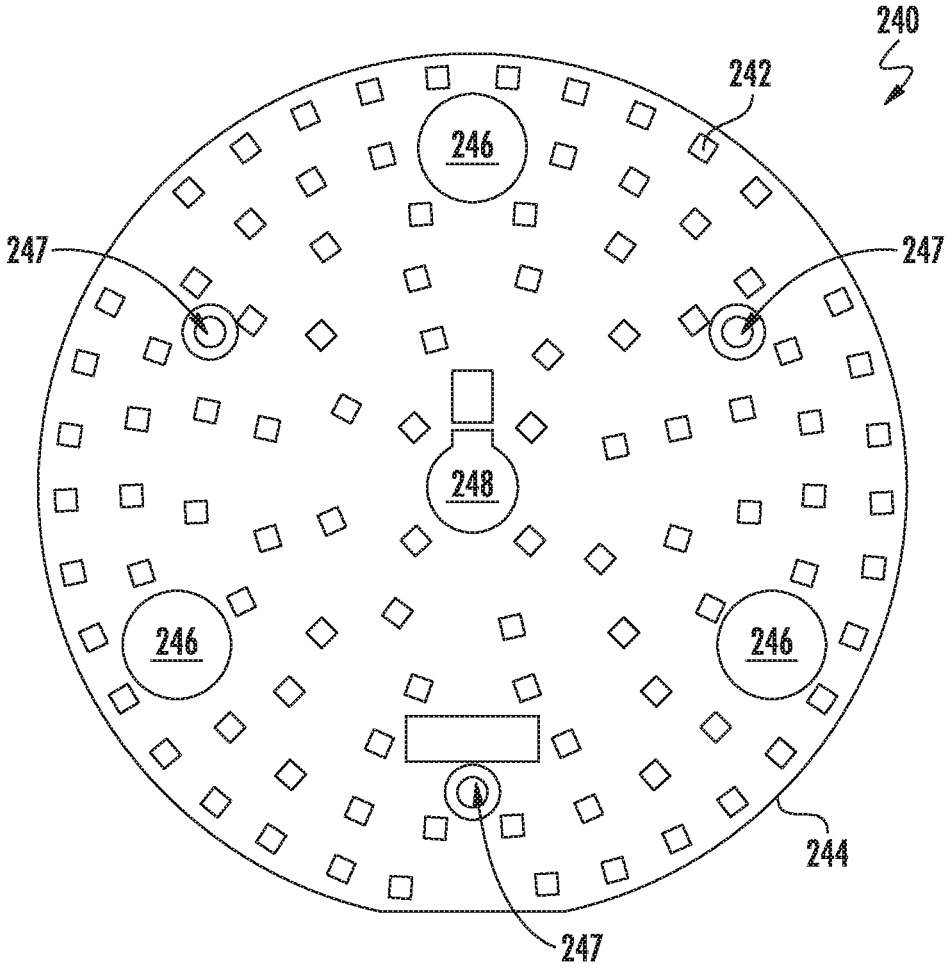
FIG. 5 depicts an example LED board of an uplight assembly according to example embodiments of the present.
Figure 6:
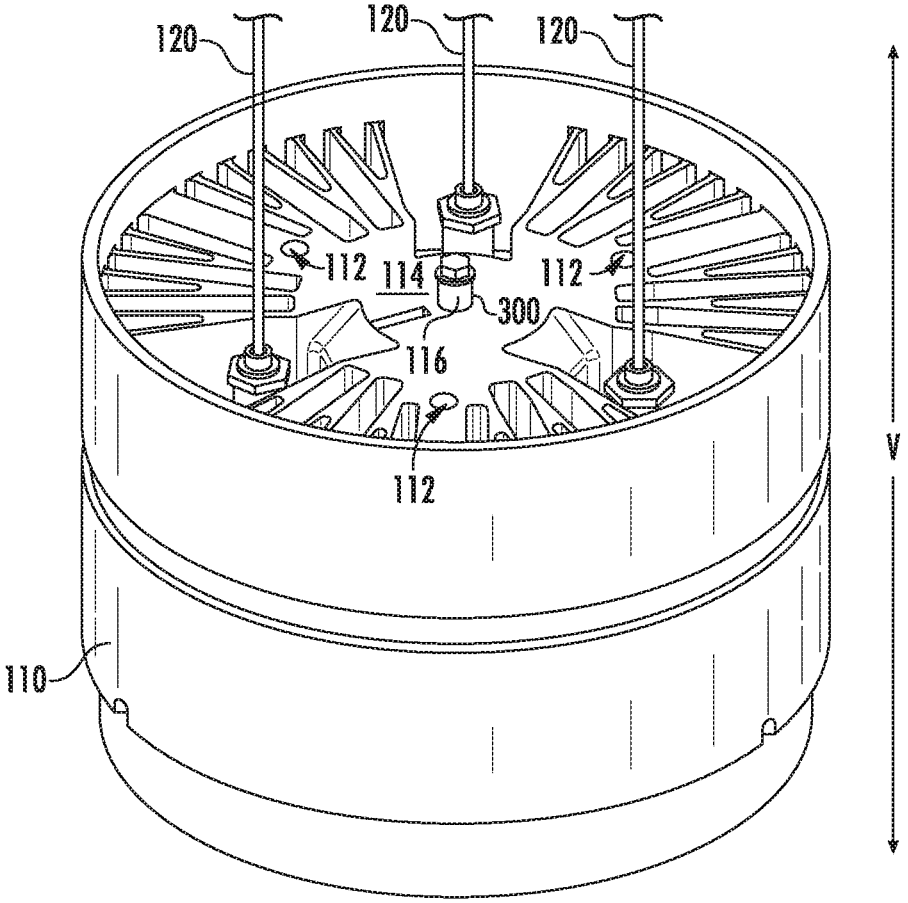
FIG. 6 depicts a top perspective view of the example pendant lighting fixture of FIG.

Referring now to FIG. 5, an LED light board 240 can include a plurality of light sources 242 arranged on a circuit board 244. In an example embodiment, each light source of the plurality of light sources 242 can be an LED light source that emits light as a result of electrons moving through a semiconductor material or other suitable light sources. It should be appreciated that the circuit board 244 can include a power source (not shown) configured to provide power for each of the plurality of light sources 242. For example, the power source can be a rechargeable battery.

As shown, the circuit board 244 can define a first plurality of apertures 246. In example embodiments, each aperture of the first plurality of apertures 246 can be configured to accommodate one of the hanging supports 120 (FIG. 3) extending therethrough to support the pendant lighting fixture 110. Alternatively or additionally, the circuit board 244 can define a second plurality of apertures 247. In example embodiments, each aperture of the second plurality of apertures 247 can be aligned with one of the second plurality of apertures 216 (FIG. 4) defined by the housing 210. In this way, a mechanical fastener (not shown) can extend therethrough so that the circuit board 244 can be mounted to the bottom 212 of the housing 210.

In one example embodiment, a length of the mechanical fastener used to mount the circuit board 244 to the bottom 212 of the housing 210 can be greater than a height H of the sidewall 220 of the housing 210. Further, the housing 210 can be positioned on the pendant light fixture 110 so that each of the second plurality of apertures 216 defined by the bottom 212 of the housing 210 is aligned with one of a plurality of apertures 112 (FIG. 6) defined by a surface 114 of the pendant lighting fixture 110. Still further, since the length of the mechanical fastener is greater than the height H (FIG. 3) of the sidewall 220, it should be appreciated that the mechanical fastener can extend into one of the plurality of apertures 112. In one example embodiment, the length of the mechanical fastener can be sufficiently long so that the housing 210 to be spaced apart from the surface 114 of the pendant lighting fixture 110 along a vertical direction V.

Figure 4:
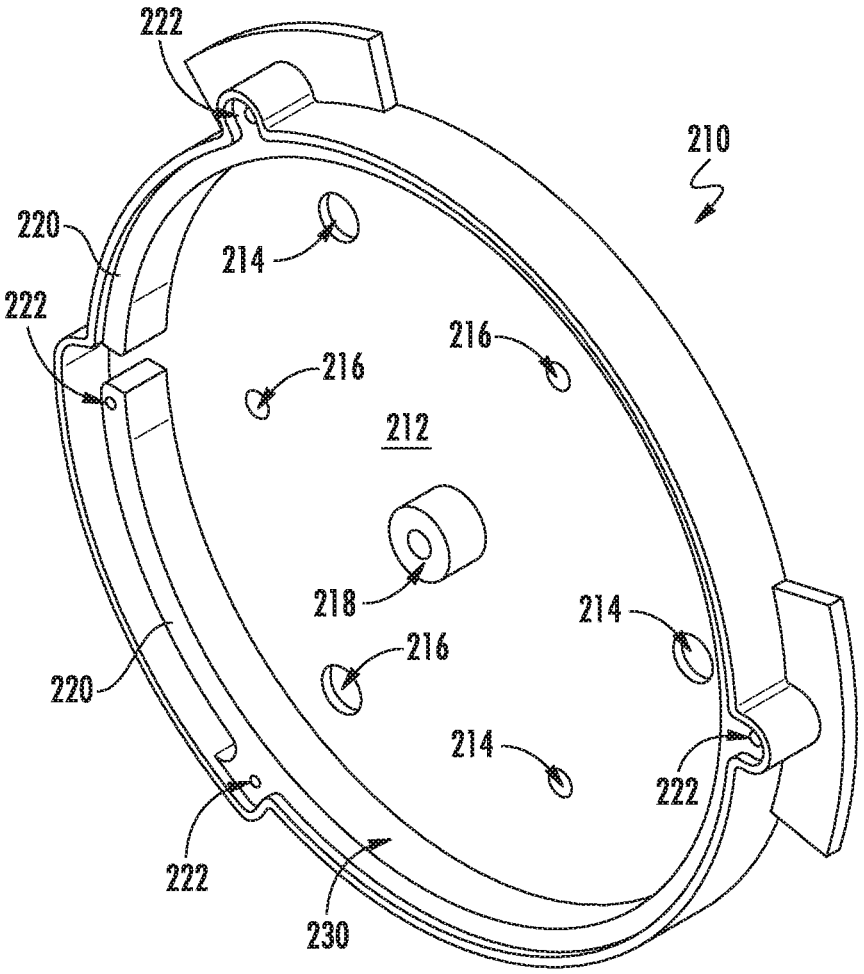
FIG. 4 depicts an example housing of an uplight assembly according to example embodiments of the present disclosure.

The circuit board 244 can also define an aperture 248 to accommodate the boss 218 (FIG. 4). More specifically, the aperture 248 can be positioned at a center of the circuit board 244. In this way, the boss 218 can extend through the aperture 248 when the circuit board 244 is positioned within the cavity 230 (FIG. 4). Accordingly, it should be appreciated that the boss 218 extends through the aperture 248 when the circuit board 244 is, as discussed above, mounted to the housing 210 via the mechanical fastener.

When the circuit board 244 is positioned within the cavity 230, the plurality of light sources 242 can provide uplighting, for instance, to illuminate the ceiling 50 or other surface located above the pendant mount lighting fixture 110. In one example embodiment, the plurality of light sources 242 can be arranged so as to at least partially surround (or fully surround) each aperture of the plurality of apertures 246. In this way, the plurality of light sources 242 can provide light onto the hanging supports 120 passing therethrough so that shadows resulting from the hanging supports 120 can be reduced.

Figure 7:
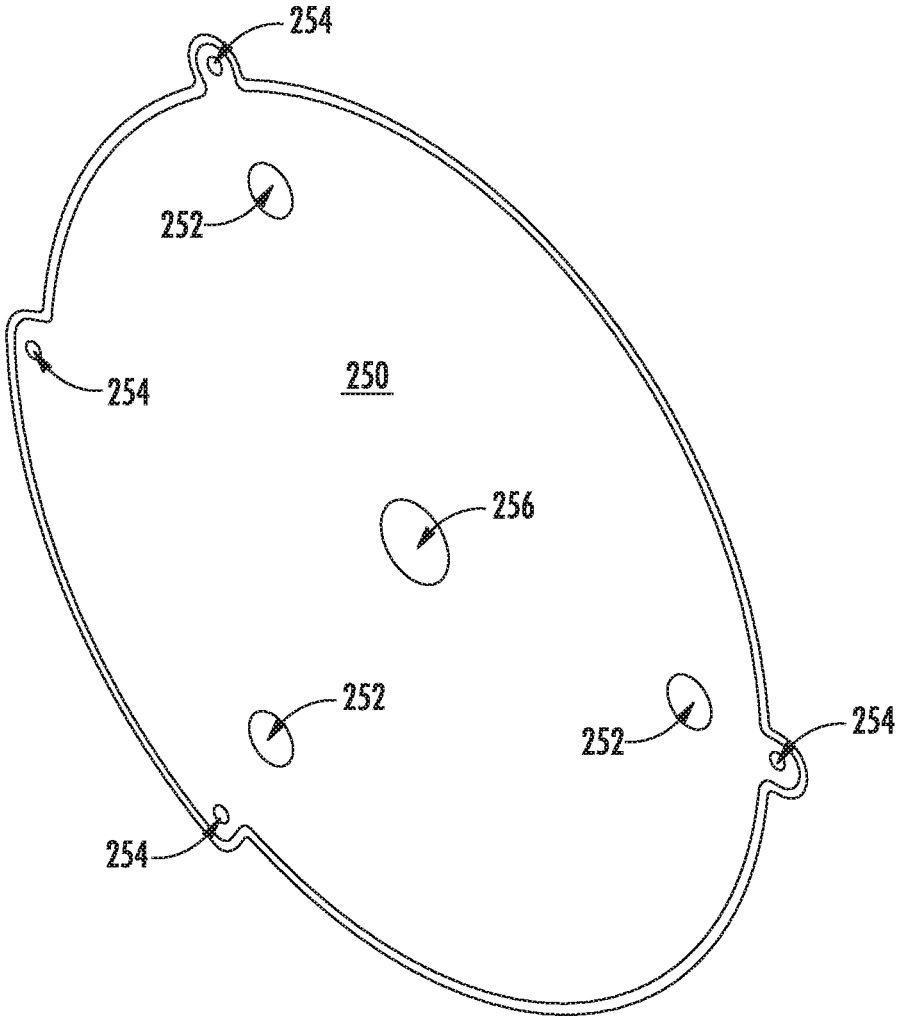
FIG. 7 depicts an example diffuser optical element of an uplight assembly according to example embodiments of the present disclosure.
Figure 8:
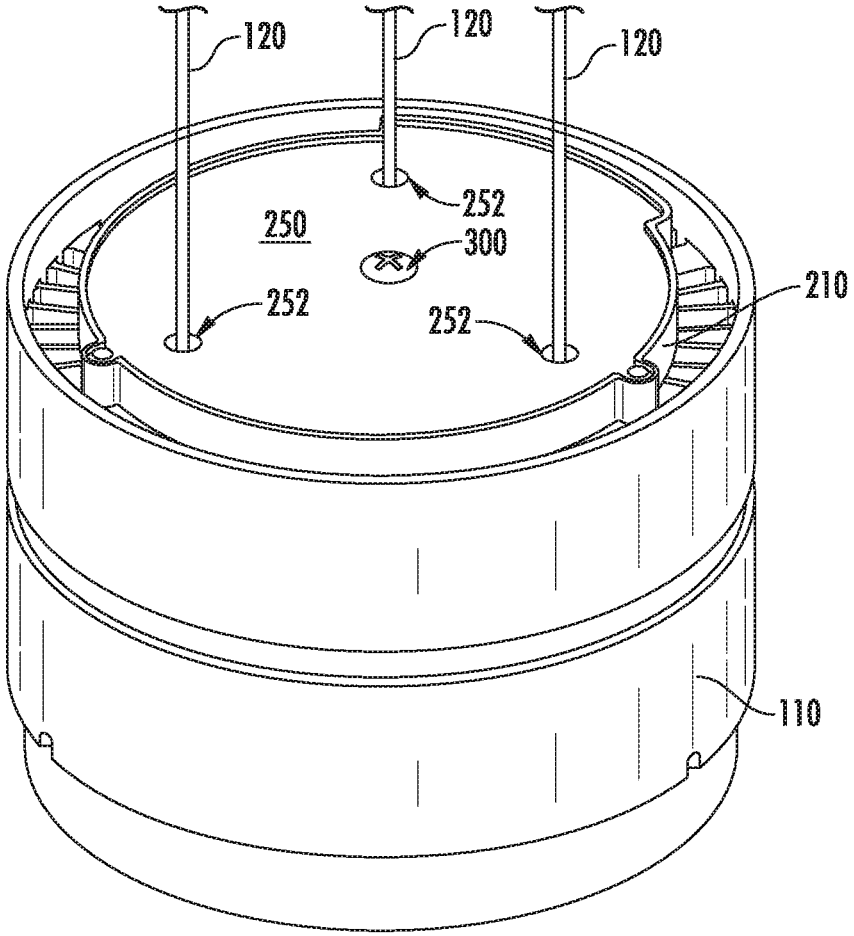
FIG. 8 depicts an example uplight assembly mounted to the example pendant lighting fixture of FIG. 1.

Referring now to FIGS. 4 through 8, example embodiments of the uplight assembly 200 can include a diffuser optical element 250 (FIG. 7). As shown, the diffuser optical element 250 can define a first plurality of apertures 252. In example embodiments, each aperture of the first plurality of apertures 252 can accommodate one of the hanging supports 120 passing therethrough to support the pendant lighting fixture 110. Alternatively or additionally, the diffuser optical element 250 can define a second plurality of apertures 254. In example embodiments, the diffuser optical element 250 can be positioned on the housing 210 so that each aperture of the second plurality of apertures 254 is aligned with a plurality of apertures 222 defined by the sidewall 220 of the housing 210. In this way, a mechanical fastener can extend therethrough so that the diffuser optical element 250 can be mounted to the housing 210.

As shown, the diffuser optical element 250 can also define an aperture 256. In example embodiments, the aperture 256 can be positioned at a center of the diffuser optical element 250. In this way, the aperture 256 can be aligned with the boss 218 when the diffuser optical element 250 is mounted to the housing 210. Further, a mechanical fastener 300 can extend therethrough so that the housing 210 can be mounted to the pendant lighting fixture 110. In one example embodiment, the mechanical fastener 300 can extend into a boss 116 (FIG. 6) extending from the surface 114 of the pendant lighting fixture 110. More specifically, threads formed on the mechanical fastener 300 can mate with threads formed on the inside of the boss 116 so that the housing 210 can be mounted to the pendant lighting fixture 110.

When the diffuser optical element 250 is mounted to the housing 210, the LED circuit board 240 is enclosed within the cavity 230. Further, the diffuser optical element 250 can be in optical communication with the plurality of light sources 242 (FIG. 6) positioned within the cavity 230 (FIG. 4). When the diffuser optical element 250 is in optical communication with the plurality of light sources 242, it should be appreciated that the diffuser optical element 250 can diffuse light emitted by the plurality of light sources 242. In example embodiments, the diffuser optical element 250 can diffuse light so as to provide a more uniform application of light onto each of the hanging supports 120 from multiple directions. In this way, the uplight assembly 200 can further reduce shadows resulting from each of the hanging supports 120.

Figure 9:
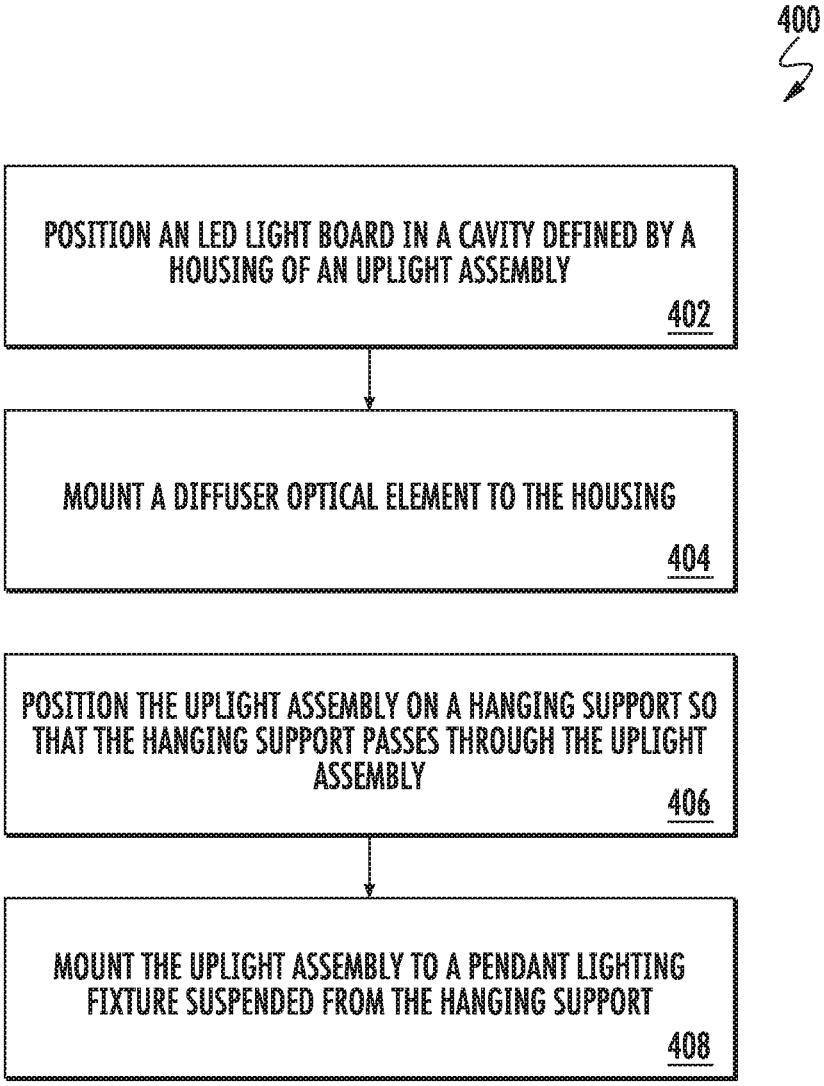
FIG. 9 depicts an example method for installing an uplight assembly according to example embodiments of the present disclosure.

Referring now to FIG. 9, a flow diagram of one embodiment of a method 400 for installing an uplight assembly is illustrated in accordance with example embodiments of the present disclosure. In general, the method 400 will be discussed herein with reference to the pendant mount lighting fixture system 100 and uplight assembly 200 described above with reference to FIGS. 1-8. However, it should be appreciated by those of ordinary skill in the art that the disclosed method 400 can generally be implemented with pendant mount lighting fixture systems having any other suitable configuration. In addition, although FIG. 9 depicts steps performed in a particular order for purposes of illustration and discussion, the method discussed herein is not limited to any particular order or arrangement. One skilled in the art, using the disclosure provided herein, will appreciate that various steps of the method disclosed herein can be omitted, rearranged, combined, and/or adapted in various ways without deviating from the scope of the present disclosure.

As shown in FIG. 9, at (402), the method 400 can include positioning an LED light board in a cavity defined by a housing of an uplight assembly. Specifically, in one example embodiment, the LED light board can be positioned within the cavity defined by the housing so that a boss extending from a bottom of the housing extends through an aperture defined by the LED light board. At (404), the method 400 can include mounting an optical diffuser element to the housing. Specifically, in one example embodiment, the optical diffuser element can be mounted to the housing so that the LED light board is enclosed within the cavity.

At (406), the method 400 can include positioning the uplight assembly on hanging supports for a pendant lighting fixture. Specifically, in one example embodiment, the uplight assembly can be positioned on the hanging supports so that the each hanging support passes through the optical diffuser element, LED light board and housing. At (408), the method 400 can include mounting the uplight assembly to the pendant lighting fixture. Specifically, in one example embodiment, the housing can be mechanically coupled to the pendant lighting fixture.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A pendant lighting fixture system, comprising:

a pendant lighting fixture; at least one hanging support couplable to the pendant lighting fixture to support the pendant lighting fixture from a ceiling; and an uplight assembly comprising, a housing defining a cavity having an outer edge, and a plurality of light sources arranged on a circuit board positioned within the cavity, wherein when the at least one hanging support is coupled to the pendant lighting fixture, the housing is positioned on the pendant lighting fixture such that the at least one hanging support passes through and extends beyond one or more apertures defined by the housing, the plurality of light sources provide light on the at least one hanging support from a plurality of different directions, at least one of the light sources positioned closer to the outer edge of the cavity than the hanging support and wherein the light reduces a shadow of the at least one hanging support on the ceiling.

2. The pendant lighting fixture system of claim 1, wherein the plurality of light sources comprises a plurality of light emitting diode (LED) devices.

3. The pendant lighting fixture system of claim 1, wherein the housing is releasably secured to an upper portion of the pendant lighting fixture.

4. The pendant lighting fixture system of claim 1, wherein the plurality of light sources are configured to emit light in a direction towards the ceiling.

5. The pendant lighting fixture system of claim 2, wherein when the at least one hanging support is coupled to the pendant lighting fixture, the at least one hanging support passes through one or more apertures defined by the circuit board.

6. The pendant lighting fixture system of claim 2, wherein the-uplight assembly further comprises:

a diffuser optical element mounted to the housing such that the diffuser optical element is in optical communication with the plurality of LED devices.

7. The pendant lighting fixture system of claim 5, wherein the plurality of LED devices surround the one or more apertures defined by the circuit board.

8. The pendant lighting fixture system of claim 6, wherein when the at least one hanging support is coupled to the pendant lighting fixture, the at least one hanging support passes through one or more apertures defined by the diffuser optical element.

9. An uplight assembly for a pendant lighting fixture couplable to at least one hanging support to suspend the pendant lighting fixture from a ceiling, the uplight assembly comprising, a housing defining a cavity having an outer edge, a circuit board positioned within the cavity, the circuit board comprising a plurality of light sources, and a diffuser optical element mounted to the housing such that the diffuser optical element is in optical communication with the plurality of light sources, wherein when the at least one hanging support is coupled to the pendant lighting fixture, the housing is positioned on the pendant lighting fixture such that the at least one hanging support passes through and extends beyond one or more apertures defined by the housing, the plurality of light sources emit light on the at least one hanging support from a plurality of different directions, and at least one of the light sources positioned closer to the outer edge of the cavity than the hanging support and wherein the light reduces a shadow of the at least one hanging support on the ceiling.

10. The uplight assembly of claim 9, wherein the plurality of light sources comprises a plurality of light emitting diode (LED) devices.

11. The uplight assembly of claim 9, wherein the plurality of light sources are configured to emit light in a direction towards the ceiling.

12. The uplight assembly of claim 9, wherein the housing is secured to an upper portion of the pendant lighting fixture.

13. The uplight assembly of claim 9, wherein when the at least one hanging support is coupled to the pendant lighting fixture, the at least one hanging support passes through one or more apertures defined by the circuit board.

14. The uplight assembly of claim 9, wherein when the at least one hanging support is coupled to the pendant lighting fixture, the optical diffuser element diffuses the light emitted from the plurality of light sources.

15. The uplight assembly of claim 9, wherein the housing is releasably secured to an upper portion of the pendant lighting fixture.

16. The uplight assembly of claim 10, wherein the plurality of LED devices surround the one or more apertures defined by the circuit board.

17. A pendant lighting fixture system, comprising:

a pendant lighting fixture having one or more light sources configured to emit light in a first direction; at least one hanging support couplable to the pendant lighting fixture to support the pendant lighting fixture from a ceiling; and an uplight having a housing defining a cavity with an outer edge and a light engine positioned in the cavity, the light engine having a plurality of light sources configured to emit light in a second direction different from the first direction, wherein when the at least one hanging support is coupled to the pendant lighting fixture the housing is positioned on the pendant lighting fixture such that the at least one hanging support passes through and extends beyond one or more apertures defined by the housing, wherein at least one of the light sources positioned closer to the outer edge of the cavity than the hanging support and wherein the light reduces a shadow of the at least one hanging support on the ceiling.

* * * * *